US006053441A

United States Patent [19]

Danforth et al.

[11] Patent Number: 6,053,441

[45] Date of Patent: Apr. 25, 2000

[54] TOROIDAL FLOW PULPER FOR DIFFICULT MATERIALS

[75] Inventors: Donald W. Danforth, Andover; Glen I. Urquhart, Southboro, both of Mass.

[73] Assignee: Bolton-Emerson Americas, Inc., Lawrence, Mass.

[21] Appl. No.: 08/923,679

[22] Filed: Sep. 4, 1997

[51] Int. Cl.[7] ..... B02C 23/36

[52] U.S. Cl. ..... 241/46.11

[58] Field of Search ..... 241/46.11, 17, 241/21

[56] References Cited

U.S. PATENT DOCUMENTS 3,428,261 2/1969 Moulton ..... 241/21

4,365,761 12/1982 Danforth ..... 241/21

*Primary Examiner*—Joseph J. Hail, III

*Attorney, Agent, or Firm*—Peter J. Manus

[57] ABSTRACT

To defiber a wide variety of materials, rotor and stator constructions are varied 1) to increase the agitation of stock in a tank or 2) to increase defibering effectiveness and increase flow rate through a recirculation line or to downstream equipment. To increase agitation, lobes of the stator are configured and sized to reduce the stator-rotor interface below 50% of its maximum possible value. To increase defibering effectiveness and increase the recirculation flow rate, the stator lobes are configured and sized so the stator area at the interface exceeds 50% of its maximum possible value. These lobe area changes are made in a way that also preserves a desired acquisition angle on cutting edges on rotor for the given material so that the lobes reliably "acquire" and reduce the stock. To increase homogeneity of treatment, deflectors on the stator and/or rotor require that all the stock traverses the defibering interface between peripheral teeth on the rotor and opposed stator bars. To increase the operational life of the rotor-stator pair, the rotor has an axially-thickened, cylindrically-shaped peripheral flange and is periodically axially advanced toward the stator to compensate for wear. To extend rotor-stator life when operating on very abrasive materials, the leading edges of the rotor blades are profiled at their tips to distribute the wear more evenly. To defiber more finely or more coarsely, the number and spacing of the rotor teeth are changed. For coarse milling, at least the tooth before each of a set of equiangularly spaced rotor blades is omitted.

4 Claims, 13 Drawing Sheets

TOROIDAL FLOW PULPER FOR DIFFICULT MATERIALS

BACKGROUND OF THE INVENTION

This invention relates in general to reduction and defibering machinery and methods. More specifically, it relates to an improved pulper rotor-stator that defibers a wide range of difficult materials, that can increase selectively the agitation flow or defibering and recirculation flow of a stock, and can do so with an extended service life.

Pulpers are typically used in the paper and pulp industry to reduce a stock material, such as wood pulp, into a watery slurry suitable for making paper. The stock material is added to a tank of water incorporating a rotor-stator pair where the stock material is broken down into fibers of a suitable size and consistency to make the desired paper product.

Until the introduction of the pulper described and claimed in U.S. Pat. No. 4,365,761, it was impossible to defiber a variety of materials in pulpers. These "unconventional" or "difficult" materials include cotton, hemp, flax, rag, leather, high wet strength papers, synthetic fibers, sheets of stock formed of fibrous material bound by adhesives, and in particular, the high wet strength board known as "shoe board". The defibering difficulty affects not only the cost and quality of the final paper product, but also the ability to recycle old paper products into new paper products, thereby avoiding landfill and saving trees.

The pulper described in U.S. Pat. No. 4,365,761 uses a rotor and stator operating at close clearance (e.g. 0.010 inch). The rotor and stator are configured to "acquire" and cut difficult materials with a scissor-like action at a size reduction interface having a truncated conical geometry. This interface is defined in part by a series of generally triangular segments, or lobes, of the stator, which each curve along the outer edge of a generally circular base. Each lobe also inclines inwardly. The inner surface of these lobes defines a conical, as opposed to a cylindrical, interface. An outer cutting edge of blades, on the base of the rotor define the inner boundary of this interface. Scissoring occurs between these blade cutting edges and the leading edge of each triangular stator lobe. Once acquired and reduced to a sufficiently small size, the material is defibered in the attrition zone of the pulper between the lobes and the outer edges of the blades.

This interface reduces in size large stock such as large sheets of shoe board and woven or natural cotton into "flakes" that can be further defibered without clogging. To date the '761 pulper, sold by Bolton-Emerson Americas, Inc. under the registered trade designation "Tornado®" is the only commercial pulper which can handle such materials. The Tornado® pulper is believed to be used to prepare the slurries that make about half of the paper currencies now in circulation throughout the world.

The energy input to the Tornado® pulper is used to reduce in size and defiber the material, to recirculate the flow of defibered stock back to the pulper (or, alternatively, to transfer stock downstream on a continuous basis), and to agitate the stock held in the tank using a toroidal flow. The pulper must also effectively deal with problems such as the tendency of some stock to float or settle in the tank ("submergence"), plugging of the defibering mechanisms, and "slugging" due to the rapid introduction of a mass of difficult material to the acquisition and attrition zones of the rotor-stator pair.

While the '761 Tornado® rotor-stator design works well, it is adapted for use in conjunction with a standard size tank (7.5 foot inside diameter) and designed principally for defibering materials used in making paper and cardboard products. If it is placed on a larger size tank, (e.g., one with a 12 foot inside diameter), more power is required to produce sufficient agitation in the tank to mix the stock and draw it to the pulper. But more importantly, there is now a demand for a pulper which can effectively defiber a much wider range of materials to produce products very different from paper.

For example, it is now desired to pulverize municipal solid waste (MSW) so that it can be fed to a reactor to make high energy liquid fuel to fire power plants. It is also desired to reduce MSW to fuel pellets for power generation. There is also an interest in "atomizing" scrap leather for conversion into pure protein for animal and human consumption. Another application is defibering old polypropylene carpeting and carpet scraps so that the fibers can be re-pelletized to make new plastic products. Agricultural products such as hemp, flax, kenaf, and straw, if defibered, can be made into various paper products. It is also desired to transform (i) "trash" fish and fish parts into liquid fertilizer, (ii) manure into fuels or fertilizer, (iii) old books and magazines into mulch, and (iv) even process the contents of old landfills in order to reclaim the land.

These different materials and different end uses for a defibered product each present special processing problems. To produce an efficient and rapid pulping—without heat and chemicals—the pulper design must somehow accommodate significant differences in the raw materials, their flow characteristics, and their submergence in the tank as well as operating parameters such as consistency of the defibered stock, production rate, the amount of agitation required, and the recirculation flow rate. For example, where larger tanks are already installed, or they are needed to handle the raw material, more of the available power must be directed to agitation. Stronger raw materials, on the other hand, require more power for ripping and shredding. Homogeneity of the treatment to provide a high degree of uniformity of the size of the processed fibers is important in other end use applications. Different materials and end applications for the stock also influence the degree to which the rotor-stator pair must meet the design needs of 1) a scissor-like shearing action 2) a refiner-like defibering action, and 3) extraction (of small fibers to an extraction chamber and then to a recirculation line or to downstream equipment). The rotor-stator design must also be able to alter the distribution of power among recirculation, agitation of the stock within the tank, and defibering. To date, known pulper construction cannot meet these various design considerations for the many possible applications, particularly those outside of the paper and pulp industry.

In addition, known pulpers continue to suffer from wear. Wear is particularly troublesome in dealing with highly abrasive materials such as those used in certain flooring bases. Replacement of rotor-stator components requires costly production down-time as well as the cost of replacement parts.

Further, it may be desired to control the operation of a known Tornado® pulper to defiber materials "coarsely", to an unusually long fiber length. The rotor-stator interface is essentially a highly effective moving screen that rapidly reduces material to a defibered state. Under normal operating conditions, coarse fibers will be reduced in size. There is also a need to defiber to unusually short fiber lengths—a "fine" defibering—and within reasonable commercial production parameters, e.g., without repeated recycling or pre-pulper or post-pulper processing.

It is, therefore, a principal object of the present invention to provide a rotor-stator assembly for, and method of operation of, a pulper which can defiber a wide range of difficult raw materials for the production of a wide range of end products.

Another principal object of the present invention is to increase pulper production without sacrificing defibering effectiveness or energy usage efficiency.

Yet another object is to provide either increased agitation or a greater effectiveness in defibering and increased recirculation.

A further object is to provide a rotor design and method of operation of a rotor-stator pair which can readily compensate for wear at the rotor-stator interface while maintaining the aforementioned operational advantages, even when processing highly abrasive materials.

Still another object is to provide a rotor-stator assembly and method of operation which can provide greater homogeneity of treatment and thus produce a stock with a high degree of consistency in the length of the fibers.

A still further object of the invention is to provide a mechanically simple and reliable way to defiber to fine and coarse fiber lengths without clogging and without costly additional processing or repeated recycling, and without unusual or time sensitive modes of operation of the pulper.

SUMMARY OF THE INVENTION

A pulper includes a stock-holding tank with a rotor-stator pair mounted in the tank, typically a side-wall of the tank. A motor and drive shaft rotate the rotor within the stator. The stator has a generally circular base with a side wall typically in a series of generally triangular, curved, and inwardly inclined lobes arrayed around its periphery. The rotor is a generally circular plate that carries a set of upright blades mounted on the plate and configured to interact with an edge of the stator lobes in a scissors action as the rotor rotates. The blades and lobes define an acquisition zone where the stock is caught and cut in this scissor action to reduce it in size to a level where it can be defibered by 1) a milling action between the blade edges and cutting edges formed at bars and channels on the inner surface of each lobe and 2) a chopping action between a series of teeth formed on the outer periphery of the rotor and opposing bars on the side wall of the stator at or near its base.

The rotation of the rotor, particularly the paddle-action of the blades projecting from the rotor plate, pumps the water and stock material in the tank. The pumped flow is split between a radial flow between the lobes and a recirculation flow through channels in the stator side wall into an annular extraction chamber formed outside the tank wall to receive the defibered stock. An outlet conduit directs the defibered stock for recirculation back to the tank and/or to an outlet conduit that feeds downstream equipment.

To increase the agitation while still providing excellent defibering and recirculation without plugging, slugging, or cavitation, the lobes are constructed so that they occupy less than 50%, and for most applications preferably about ⅓, of the total surface area of the conical rotor-stator reduction interface. This reduction is made while maintaining a high degree of rotational symmetry.

In a preferred form, the stator has six lobes with pairs of adjacent lobes spaced circumferentially by distance that would otherwise be occupied by a lobe. In another form, the lobes are uniformly truncated so that their maximum axial height from the stator base is less than the axial height of the rotor vanes. In yet another form the lobes are all mutually spaced circumferentially, preferably by a distance equal to the circumferential width of one of the lobes. In still another form the lobes are continuous around the periphery, but are each "flattened" to a uniform degree. The total surface area of the lobes at the interface controls distribution of agitation/recirculation flow and the surface area available for "bar-and-channel" milling-action attrition.

To increase defibering effectiveness and increase the recirculation flow rate, the lobes are configured and sized to occupy more than 50% of the interfacial area. Additional lobes are added, and/or the size of the lobes is increased. The lobes are truncated, or retain their peaks. The angle of the lobe edges, however, is generally the same as with a standard nine lobes around the stator.

To increase homogeneity, deflectors on both the stator and rotor force the flow of stock to traverse the interface between the teeth formed in the outer edge of the rotor and the stator.

To compensate for wear at the reduction interface, the rotor plate is thickened axially at its outer periphery with a cylindrical outer surface and the axial position of the rotor is adjustable. As wear widens the clearance between the cooperating elements of the rotor and stator, the rotor is advanced towards the stator until the desired clearance is re-established. This process is repeated until the highest points of the rotor vanes and the stator lobes become generally coincident. Initially, the lobes and vanes are sized so that the lobes extend over the vanes. The extent of this initial height mismatch is reflected in the amount of peripheral thickening of the rotor plate. The rotor flange maintains the desired area of engagement between the rotor and the stator at the interface. For operation with highly abrasive materials, the upper, outer end of the rotor blade is profiled to distribute the wear more evenly over the blade end. The profiling is in the form of a wedge-shaped relief that thins the blades as it extends toward its upper end.

It has been found that the number, spacing, and, in some instances, size, of the peripheral rotor teeth produce fine or coarse defibering, without modification of the stator or other equipment. For fine defibering, the number of the rotor teeth is increased over the number heretofore standard on a comparably-sized Tornado® rotor, e.g. by about 50% to about 100%, with a corresponding reduction in the inter-tooth spacings, and usually in the width of the teeth as well. For coarse defibering, the tooth size need not change, but at least three equiangularly spaced teeth, ones that each lead an associated rotor blade, are omitted to create large inter-tooth spacings or "pockets". In another form such pockets are created before all of the rotor blades, but not at other circumferential locations. In still another form such pockets are formed between all of the rotor teeth lying between adjacent rotor blades. Elimination of teeth to create the pockets is rotationally symmetric. The number and size of the pockets is varied depending on the desired degree of coarseness in the defibering and with a given application.

Viewed as a process, the invention where increased agitation is required involves decreasing the area of the lobes at the reduction interface to a value below 50% of the total area of the interface and distributing this decrease uniformly about the stator. This reduction is done while maintaining the acquisition, attrition, and recirculation qualities necessary to defiber the particular material being processed. The area decreasing can be by spacing lobes circumferentially, truncating them, flattening them axially, or combinations of the foregoing. To enhance defibering and recirculation, the area of the lobes at the reduction interface is increased above 50% by filling in the region between lobes or increasing lobe size, with or without truncation of the lobe. The wear compensation invention, viewed as a process, includes thickening the periphery of the rotor in an axial direction and with a cylindrical outer configuration, and then periodically advancing the rotor toward the stator to maintain a slight clearance therebetween at a pre-set value.

These and other features and objectives of the present invention will be more fully understood from the following detailed description which should be read in light of the accompanying drawings.

DETAILED DESCRIPTION OF THE PREFERRED EMBODIMENTS

Figure 1:
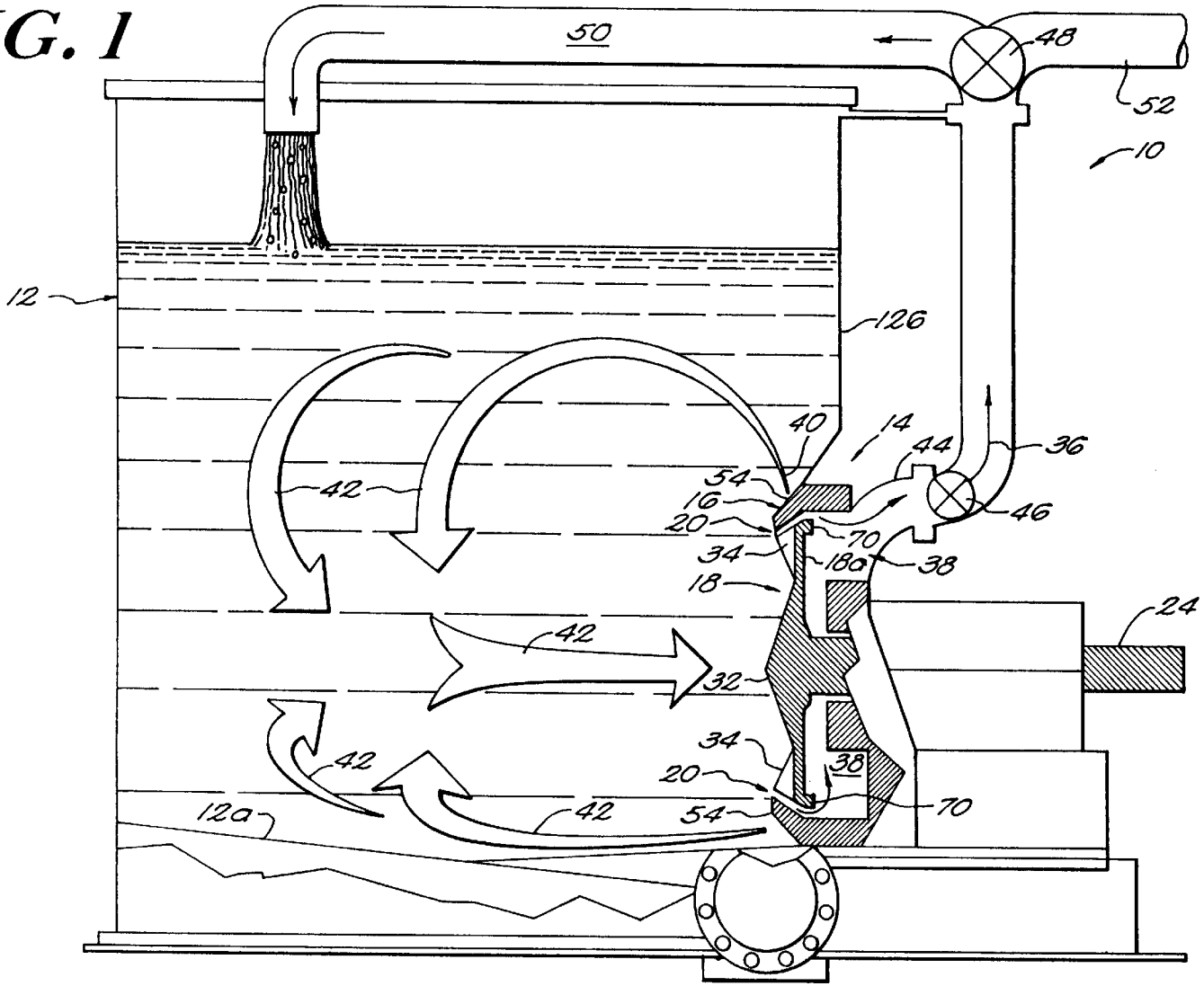
FIG. 1 is a view in vertical section and partially in side elevation of a pulper according to the present invention showing the flow of stock in a tank and through a rotor-stator pair.
Figure 2:
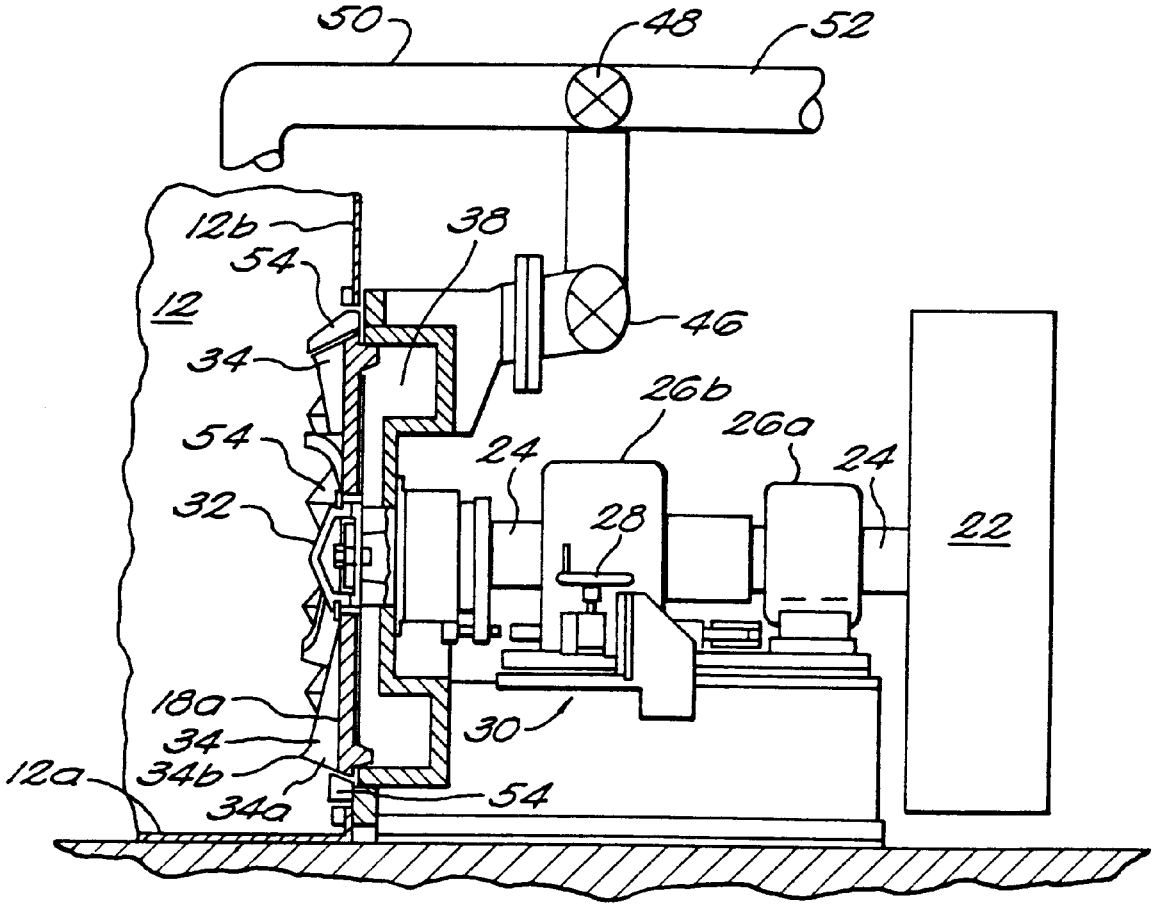
FIG. 2 is a detailed view in side elevation and partially in vertical section showing the rotor-stator pair of FIG. 1 in more detail as well as a mechanism for adjusting the axial position of the rotor.
Figure 3:
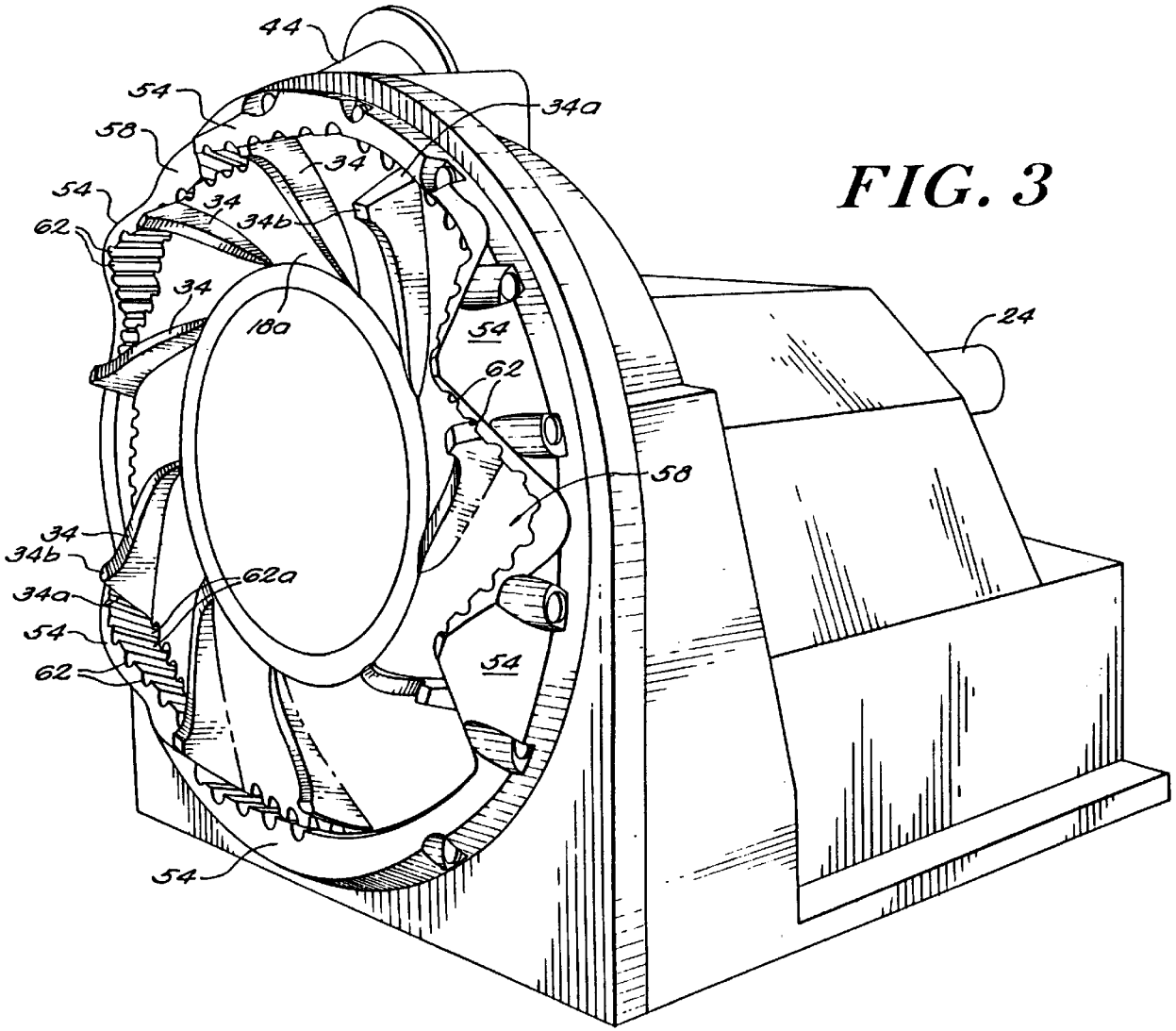
FIG. 3 is a perspective view of the pulper shown in FIGS. 1 and 2 without the tank, drive motor, power transmission train, or flow conduits.
Figure 4A:
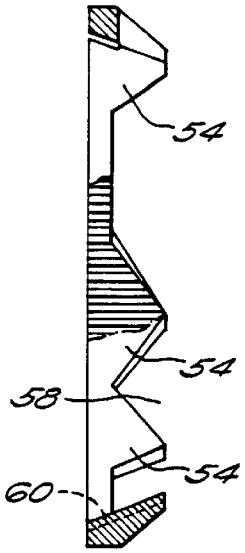
FIG. 4A is a view in vertical section taken along the line 4A—4A in FIG. 4B.
Figure 4B:
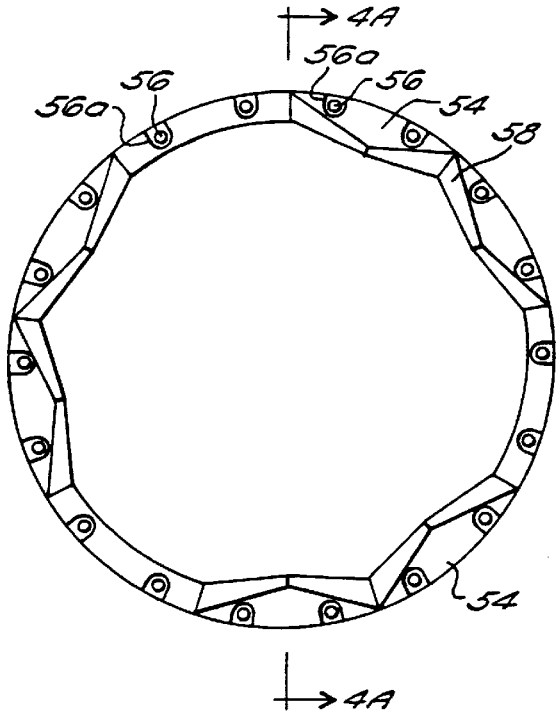
FIG. 4B is a view in front elevation of a preferred form of a stator according to the present invention, as shown in FIG. 3.
Figure 5A:
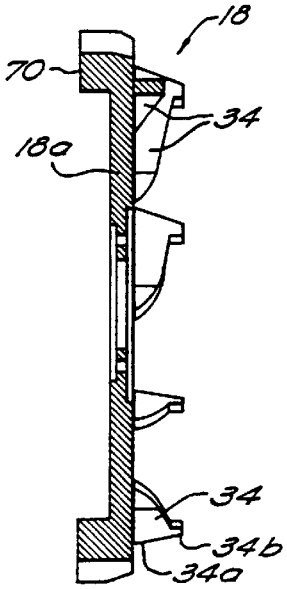
FIG. 5A is a view in vertical section taken along the lines 5A—5A in FIG. 5B.
Figure 5B:
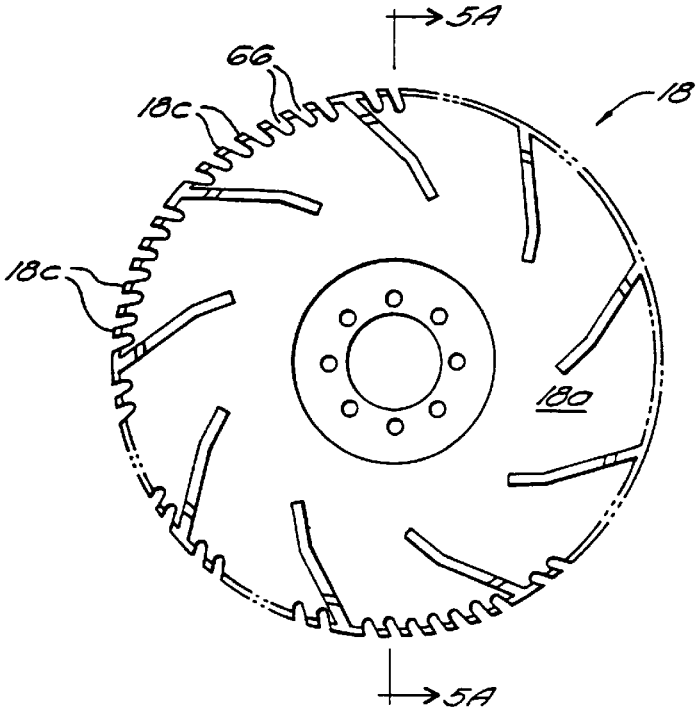
FIG. 5B is a view in front elevation of the rotor shown in FIGS. 1–3.

FIGS. 1–3 show a system 10 according to the present invention which includes a stock-holding tank 12 and a defibering pulper 14 with a stationary stator 16 and a nested, rotatable rotor 18 which together define a reduction and attrition interface 20. For many applications the interface has a slight clearance, typically 0.005 to 0.010 inch, that is uniform around the interface. However, for some applications the clearance may be reduced to zero, and, in still other applications, it is desired to use thrust, that is, to advance the rotor further to increase the power demand and to increase significantly the effectiveness of the pulper.

The tank 12 can assume a variety of shapes. As shown it is generally cylindrical with a bottom wall 12*a*, and a side wall 12*b*. With the stator construction of the present invention that increases power supplied to agitation of the stock held in the tank, the tank can have a large volumetric capacity as compared to typical tanks for pulpers operating in a batch mode. A typical capacity for the tank 12 is roughly 5,000 gallons, while a standard tank capacity is about 2,600 gallons. In terms of batch capacity in pounds, the standard tank can hold 1,000 pounds at a 5% consistency in a 7.5 foot inside diameter tank that is 9.0 feet high. A typical large tank, e.g., one with a 12-foot diameter, can handle at least a 2,000 pound batch.

The stock held in the tank is formed by adding to a supply of water a charge of a material to be defibered into the water. The invention can be used with conventional materials, but it is particularly designed to reduce in size and then to defiber difficult materials used in making paper and paper products such as raw (or cooked) cotton, stockboard stock, hemp, flax, rags, heavy latex impregnated shoe board and the like, as well as a wide variety of other materials such as a MSW, the agricultural products noted above, fish, manure, used books and magazines, and the like to make the fuel, fertilizer, mulch, compost and food products and the like, also mentioned above.

A motor 22 rotates a drive shaft 24 journalled in a set of mutually spaced bearings 26*a*, 26*b*. A handwheel 28 operating a gear and rack assembly 30, or an equivalent linear translation mechanism, moves the drive assembly axially to allow adjustment of the rotor-stator clearance at the interface 20 through an axial movement of the rotor 18 secured to one end of the drive-shaft. The drive-shaft is highly rigid to transmit a large torque and to resist bending moments that would displace the rotor and destroy the uniformity of the clearance 20.

The rotor 18 is organized about a circular plate 18*a* that mounts a nose cone 32 and a set of circulation blades 34 which project from the plate 18*a* into the tank. The blades can be cast integrally with the plate 18*a*, or welded or otherwise attached. The rotor also includes a peripheral flange which thickens the rotor axially at its outer edge. The flange stiffens the plate, but the flange 70 according to the present invention extends axially beyond merely the length needed to stiffen the rotor. This extra length, preferably at least double what has been used for stiffening alone, has been found useful in extending rotor life due to wear, as will be discussed in greater detail below. The flange has a cylindrical outer surface which wears to a conical surface.

The blades are central to the defibering through the interaction of a blade edge 34*a* and cooperating cutting and attrition edges formed or carried on the stator. They also act as pumping elements. Their rotation drives 1) a defibered stock flow 36 through the interface 20 to an extraction chamber 38 for recirculation or use and 2) a radial flow 40 out of the interface 20 which produces a toroidal flow 42 in the tank 12. The toroidal flow 42 agitates the stock in the tank; it mixes the material in the tank and continuously sweeps stock, particularly along the tank walls and along the stock surface, to the center of the tank where it is carried to the pulper 14. The useful energy applied to the system 10 by the pulper 14 is applied to size reduction and defibering, recirculation, and agitation. The rotor-stator constructions of the present invention can defiber a wide range of unconventional materials and maintain a recirculation flow while also developing a sufficiently strong toroidal agitation flow 42 so that stock held even in a large capacity tank is defibered successfully.

The recirculation flow 36 of defibered stock exits the extraction chamber 38 via conduit 44, a valve 46, and a valved "T" connection 48 which directs the flow either back into the tank 12 and/or to an outlet conduit 52, e.g., one that feeds a tank supplying a paper-making machine. The system 10 can be operated in a batch or continuous mode, with recirculation, or with a variable rate of recirculation as a percentage of the total flow through the pulper 14. The valve 48 controls the outflow rate from the pulper.

The stator 16 is organized around a generally annular, integral base 16*a* which carries a set of curved, circumferentially extending lobes 54. Each lobe 54 has the general configuration of a solid triangle that is inclined inwardly toward the axis of rotation of the drive-shaft and rotor. The inclination and curvature of each lobe is such that the inner surfaces of the lobes define a truncated conical surface that is the outer boundary of the interface 20. The inner boundary is defined, with a slight clearance of a few thousandths of an inch (or essentially no clearance in a "thrust" mode of operation), by the locus of the edges 34*a* of the moving rotor blades 34. The lobes 54 are preferably integral with the base 16*a*.

As described in detail in the aforementioned U.S. Pat. No. 4,365,761, which disclosure is incorporated herein by reference, the blade edges 34*a* and the leading, or "acquisition" blade edges 54*a* of each lobe 54 meet at an angle of 15° to 55°, and preferably at about 25° to create a scissor-like cutting action as the rotor rotates within the stator. This action is termed "acquisition" in the '761 patent, and the valleys 58 between lobe peaks are termed "acquisition spaces." This is the space where large pieces of the materials are caught and cut into smaller pieces which can then enter and be further reduced and defibered in an attrition zone 60 defined by the mill-like attrition produced between the blade edges 34*a* and series of "vertically" extending bars 62 and channels 62*a* formed on the inner surface of each lobe. Further chopping-action attrition occurs through the interaction of a set of teeth 18*c* formed on the outer edge of the rotor with the opposite stator wall with the lower portions of the bars 62 and channels 62*a*. Screws 56 received in axial holes 56*a* at the outer edge of the stator mount it.

To increase agitation the surface area of all of the stator lobes 54 is kept at a value less than 50%, and preferably about ⅓, of the total surface area of the truncated conical interface 20. This relationship produces a strengthened radial flow out of the pulper, and a correspondingly strengthened toroidal agitation flow 42—one sufficiently strong to agitate, mix and sweep floating and settling material in the tank into the pulper. The precise value of the area reduction will depend on the specific application.

This area reduction must be symmetrical around the stator so as to avoid producing moments on the rotor and the drive-shaft which would adversely affect the uniformity of the rotor-stator clearance 20. They must also be carried out in a way that does not create other problems such as plugging, cavitation, or a reduction in the ability of the pulper to acquire, reduce in size, and defiber stock material.

FIGS. 6B–6E each show as linear developments four circular lobe constructions which, when used in cooperation with the rotor 18, produce this redistribution of energy to the agitation flow. For comparison, FIG. 6A shows a linear development of a standard, prior art, nine lobe stator for a Tornado® pulper.

Figure 6A:
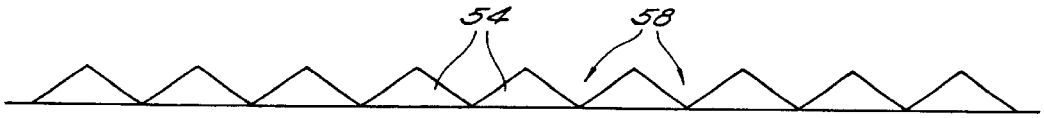
FIG. 6A (PRIOR ART)
FIG. 6A shows a prior art stator lobe design with the lobes displayed linearly and in a simplified schematic form for clarity.
Figure 6B:
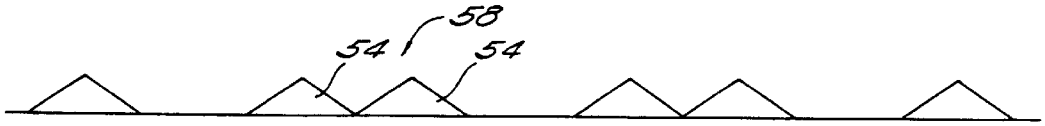
FIGS. 6B–6E are views corresponding to FIG. 6A showing alternative forms of stator lobes according to the present invention which increase agitation.
Figure 6C:
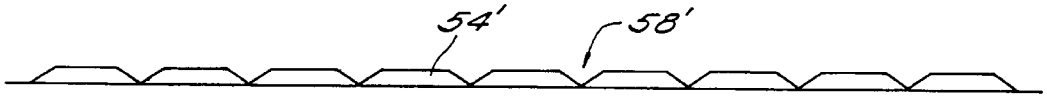
Figure 6D:
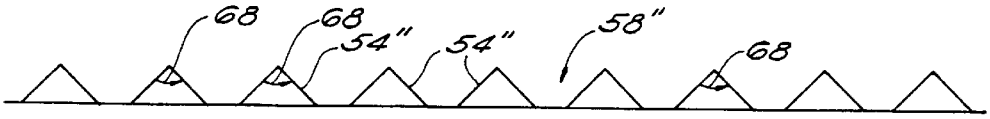
Figure 6E:
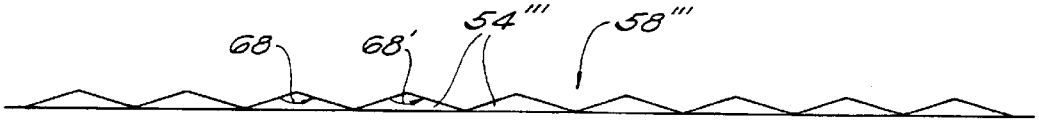
Figure 6F:
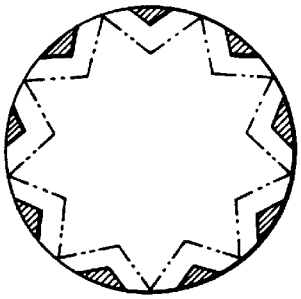
FIGS. 6F–6N are views of alternate embodiments of the stator according to the present invention, but with the stator shown in front elevation.
Figure 6G:
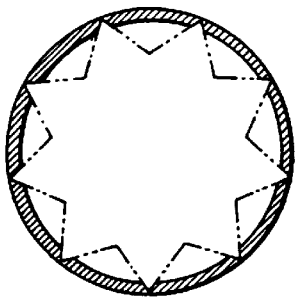
Figure 6H:
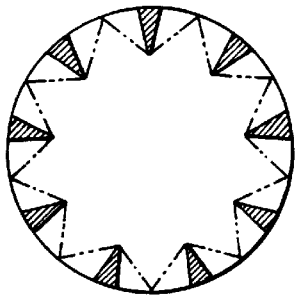
Figure 6I:
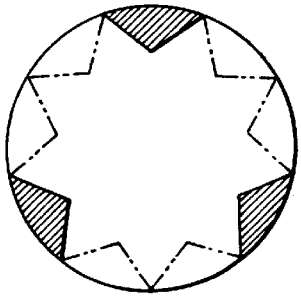
Figure 6J:
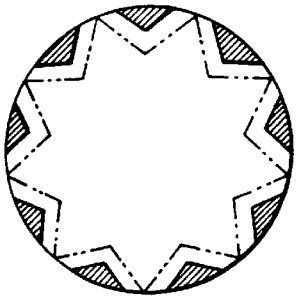
Figure 6K:
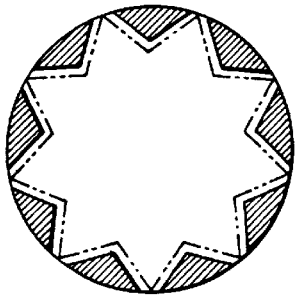
Figure 6L:
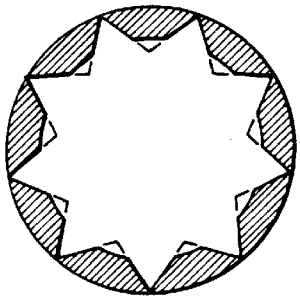
Figure 6M:
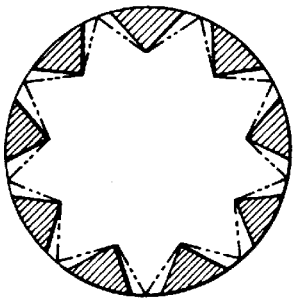
Figure 6N:
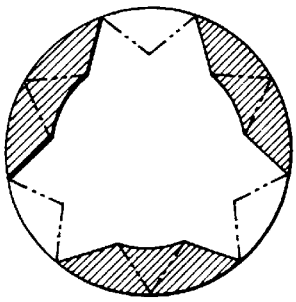

The FIG. 6B form of the invention in effect eliminates in total every third one of the nine lobes, leaving six lobes 54, in adjacent pairs, spaced by the width of one of the lobes. The lobe height in this embodiment, and other construction features, are otherwise the same as in the FIG. 6A Tornadoe® stator. FIG. 6C shows an alternative embodiment where there are nine adjacent, non-spaced lobes 54', but each lobe is truncated in a common plane parallel to the stator base 16*a*. FIG. 6D shows a variation on the FIG. 6B form, with the lobes 54" narrowed, that is, with a smaller included angle 68 at the apex of the lobe. FIG. 6E shows "flattened" lobes 54''' where the height of each lobe is lowered an equal amount by configuring the lobe 54''' with an increased included angle 68' at the apex of the lobe as compared to that of the "standard" lobe 54. The degree of narrowing or flattening must be balanced against the effect of the change of the angle of the acquisition edge 54*a* in cutting. A typical value, corresponding to the FIGS. 1–4 embodiment where 3 of 9 lobes are omitted entirely, is ⅓.

FIGS. 6F–6N show still other alternative stator embodiments useful for increasing agitation and falling within the present invention, but in front elevation of the stator. The configuration of the standard FIG. 6A stator is shown in phantom for comparison.

In each of these embodiments (FIGS. 6B–6N), these stator lobe arrays are used in cooperation with a rotor and rotor blades 34 of the same general size as used with the standard lobe 54 shown in FIG. 6A. As a result, the increased inter-lobe space and/or lowered lobe height of FIG. 6B and 6E allow the tangential pumping action of the rotating vanes to flow with less resistance than with prior art approaches, including the FIG. 6A lobe configuration, used in the standard commercial form of the Tornado® pulper.

Figure 7A:
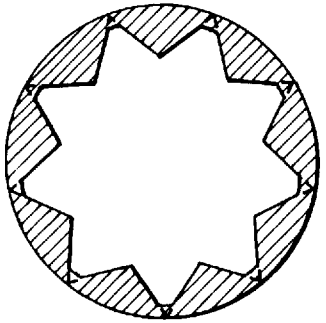
FIGS. 7A–7F are views corresponding to FIGS. 6F–6N but with the stator lobes configured and sized to increase defibering and recirculation.
Figure 7B:
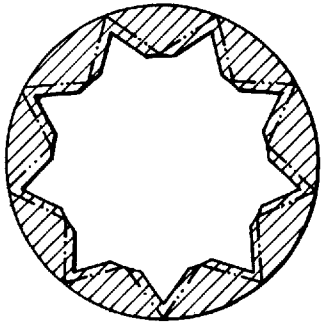
Figure 7C:
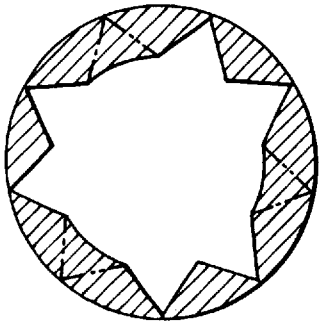
Figure 7D:
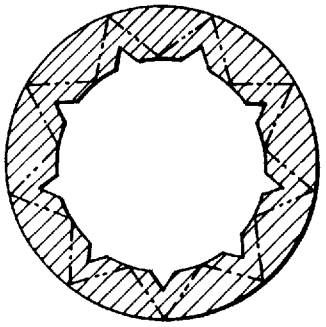
Figure 7E:
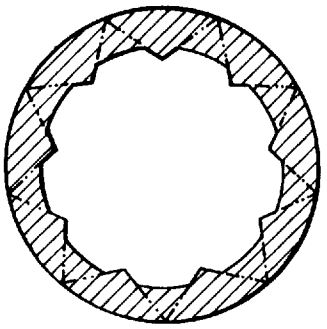
Figure 7F:
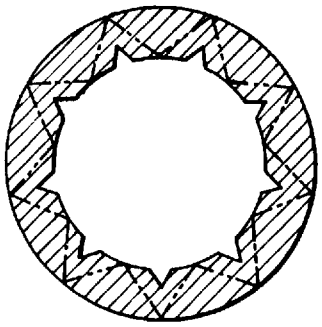

Other stator constructions shown in FIGS. 7A–7F also in front elevation, increase the defibering action and the recirculation flow of the pulper 10. In FIG. 7A, the lowest portion of the valley 58 of a nine-lobe (FIG. 6A) stator is solid (with alternating, generally axially directed bars 62 and channels 62*a* formed on its inner surface). FIG. 7B shows an embodiment with the stator side wall almost completely filling the valleys 58 of a standard nine lobe stator for even greater defibering and recirculation action. FIG. 7C shows an alternative embodiment with three equi-angularly distributed valleys 58 completely solid. FIGS. 7D–7F show three other alternative embodiments which vary the standard, FIG. 6A, nine-lobe construction by increasing the size of each lobe and trimming its peak (truncating it) to successively increase the stator area at the interface 20 while maintaining generally the same acquisition angle, about 25°, for each stator acquisition edge 54*a*. FIG. 7F would be used where the acquisition and reduction demands are small, but a maximum defibering and recirculation is desired.

In each of embodiments of FIGS. 7A–7F, the stator-rotor interfacial area is greater than 50% of the total interface area. The precise value used and the stator configuration used will depend on the particular raw material, the desired end product, and desired operating parameters.

With each of these stator embodiments (FIGS. 6B–7F) it is critical that the lobes are angularly symmetrical about the axis of rotation for the pulper. Asymmetries will produce bending moments on the drive-shaft through the resultant asymmetrical loading on the rotor. Bending moments will in turn produce a non-uniformity in the interface clearance which will seriously degrade the operation of the pulper.

Figure 8A:
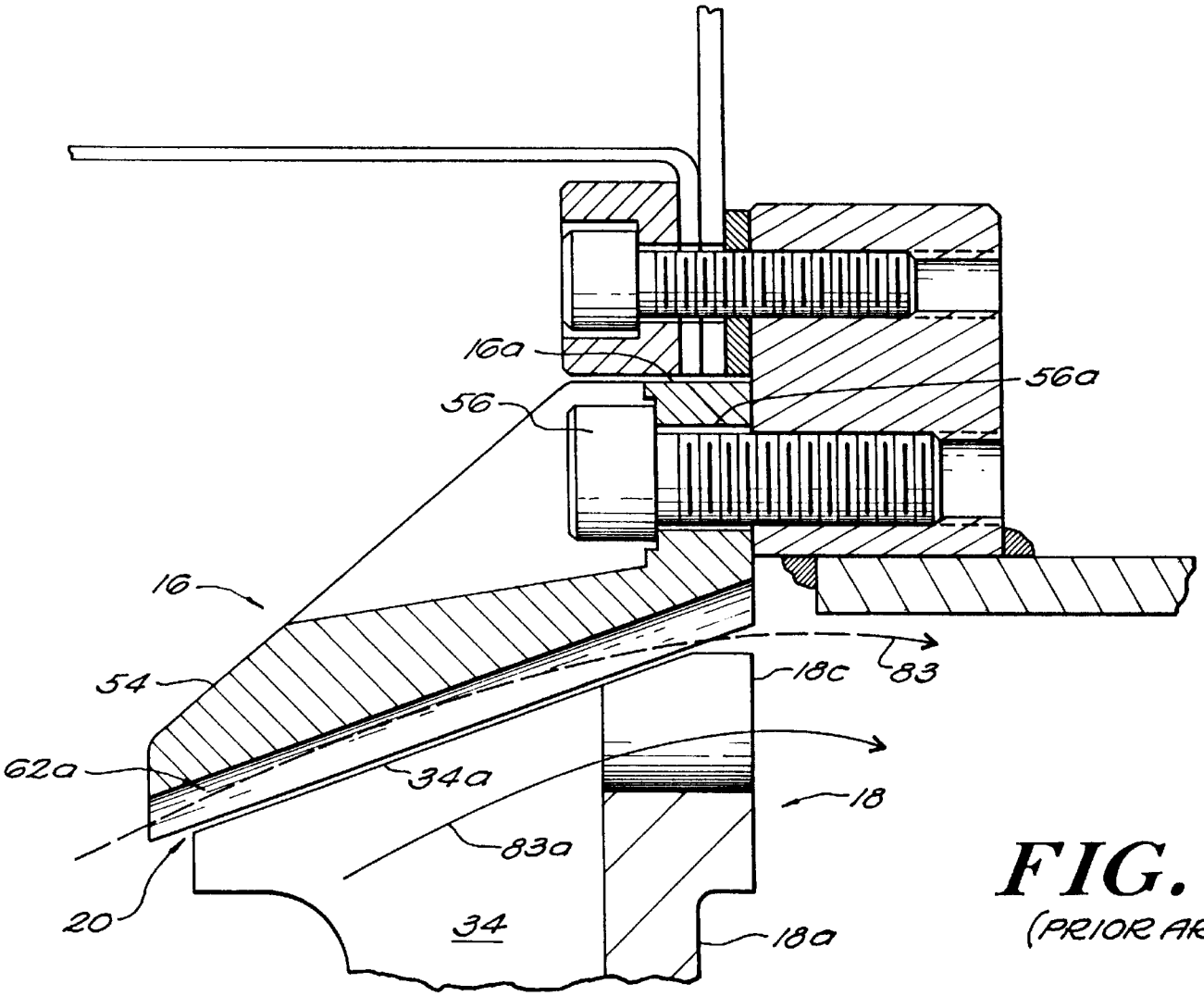
FIG. 8A (PRIOR ART)
FIGS. 8A is a detailed view of the prior art rotor-stator interface.
Figure 8B:
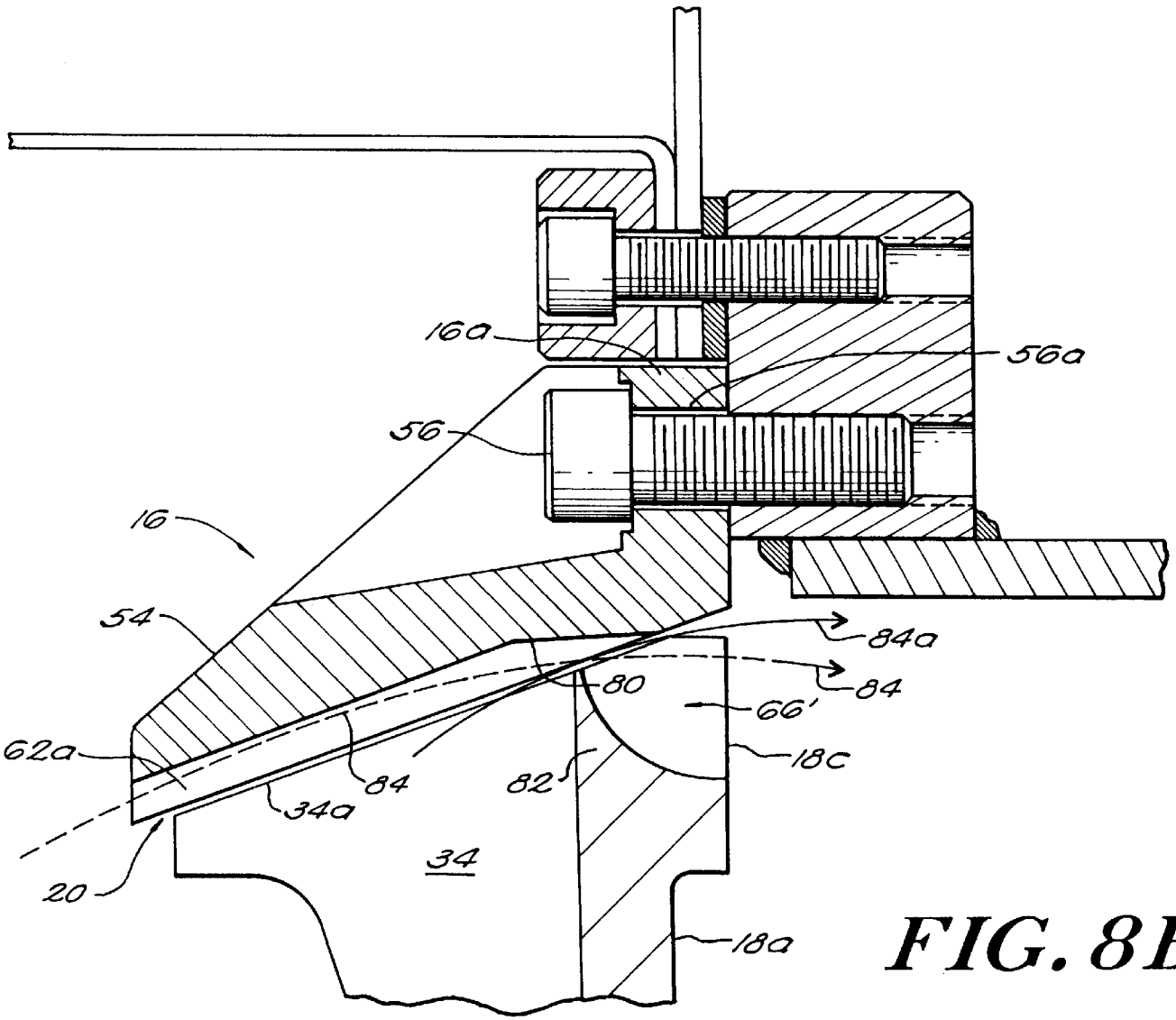
FIG. 8B is a detailed view corresponding to FIG. 8A showing a deflector arrangement according to the present invention to enhance homogeneity of treatment and uniformity of fiber length.

FIGS. 8B illustrates deflectors 80, 82 on the stator and rotor, respectively, which force the stock being defibered to flow through the chopping-action attrition zone defined by the peripheral rotor teeth 18*c* and the opposite channel and bar surface of the stator. In the '761 prior art pulper, the channels 62*a* extended generally in a straight line as indicated in FIG. 8A. As a result, material being defibered could flow straight into the extraction chamber 38, thus by-passing the chopping action of the teeth 18*c*. Flow arrow 83 shows a by-pass flow through the channel 62*a*; flow arrow 83*a* shows a by-pass flow through the circumferential spaces 66 between the rotor teeth 18*c*. (Flows 83 and 83*a* together form the defibered stock flow 36.) The deflectors 80, 82 are preferably cast in place as integral extensions of the stator base 16*a* and rotor plate 18*a*, respectively. The deflectors 80, 82 are positioned, configured, and sized, as shown, to force the stock flow pumped down the channels 62*a* by rotation of the blades 34 (as shown by flow arrows 84 and 84*a* in FIG. 8B) into the attrition region where the teeth 18*c* can act on the fibers. Each deflector 80 can be formed simply by tapering the lower end of the channels 62*d* in the form of a flat ramp that terminates short of the rear face of the station. Each deflector 82 on the rotor is preferably formed by machining (or casting) the spaces 66' between the teeth 18*c* not to extend through the rotor plate, but rather to curve to the outer edge 34*a* of the blade 34, as shown. It is thus integral with the rotor plate 18*a*.

While the preferred form of the deflection 80, 82 are shown and described, they can assume a variety of forms as long as they: i) divert the flow through the channels 62*a* (defining a first milling-action attrition zone) to a second chopping-action attrition zone defined by the teeth 18*c* and the opposed bars 62; and ii) block a by-pass flow that would otherwise avoid the second attrition zone by flowing through the openings between the teeth 18*c*. For example, the deflectors 80 can have curved, rather than flat, surfaces interacting with the flows. Rather than being integral, the deflectors 80, 82 can be solid or sheet metal deflectors welded, or otherwise secured, in place on the stator and rotor. The internal shape of the deflector 82 can also vary, e.g., it can have a more squared internal corner, that is, one that does not thin radially toward the interface 20. Further, while there is a loss in performance as compared to using both deflectors 80 and 82, it is possible to use only one of the deflectors 80 and 82 to enhance homogeneity of treatment and uniformity of fiber length. This is because with one deflector some portion of the defibered stock flow can bypass the second, milling-action attrition zone.

To cut and defiber these difficult materials, the drive-train must transmit a substantial torque. For paper and pressboard applications, typical rotor speed is 430 rpm at 350 Hp. For cotton and like applications, a typical rotor speed is 380 rpm. A 1200 rpm capacity motor delivers 250 Hp to a 36-inch diameter rotor steady-state with peak demands in excess of 300 Hp when stock is introduced. The reaction forces on the rotor-stator pair are likewise substantial. Despite the use of hardened steel alloys for cutting and attrition edges, there is steady wear on the rotor and stator at the interface 20.

Figure 9A:
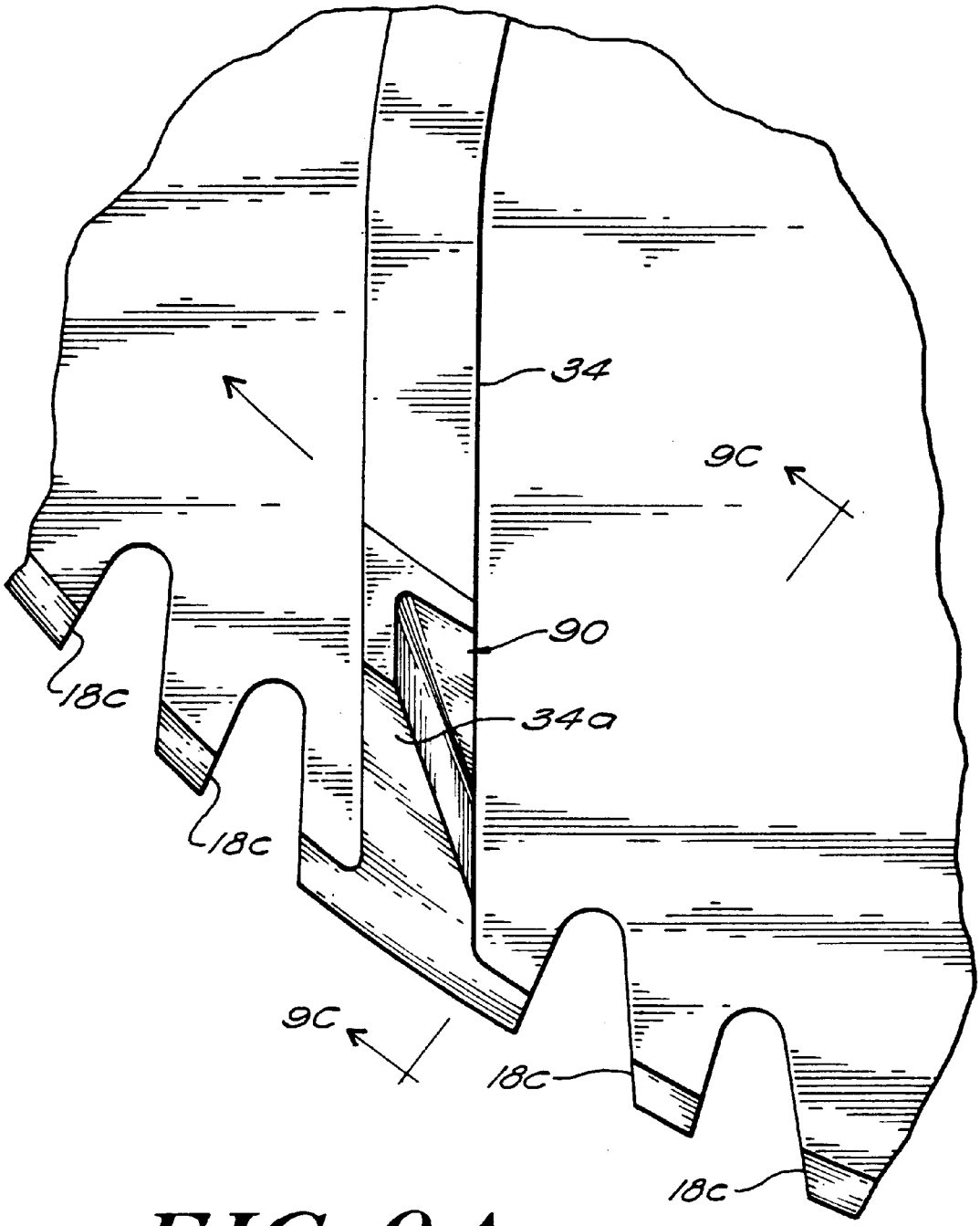
FIGS. 9A and 9B are detailed views in top plan and end view of the profiled rotor blade end according to the present invention.
Figure 9B:
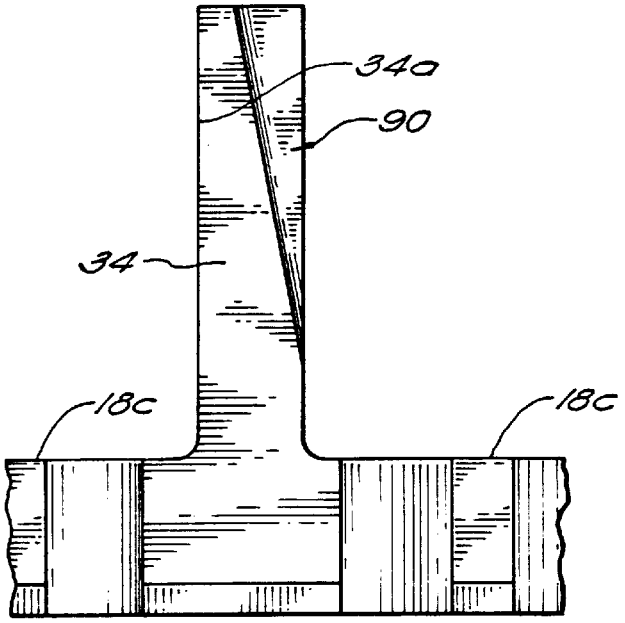
Figure 9C:
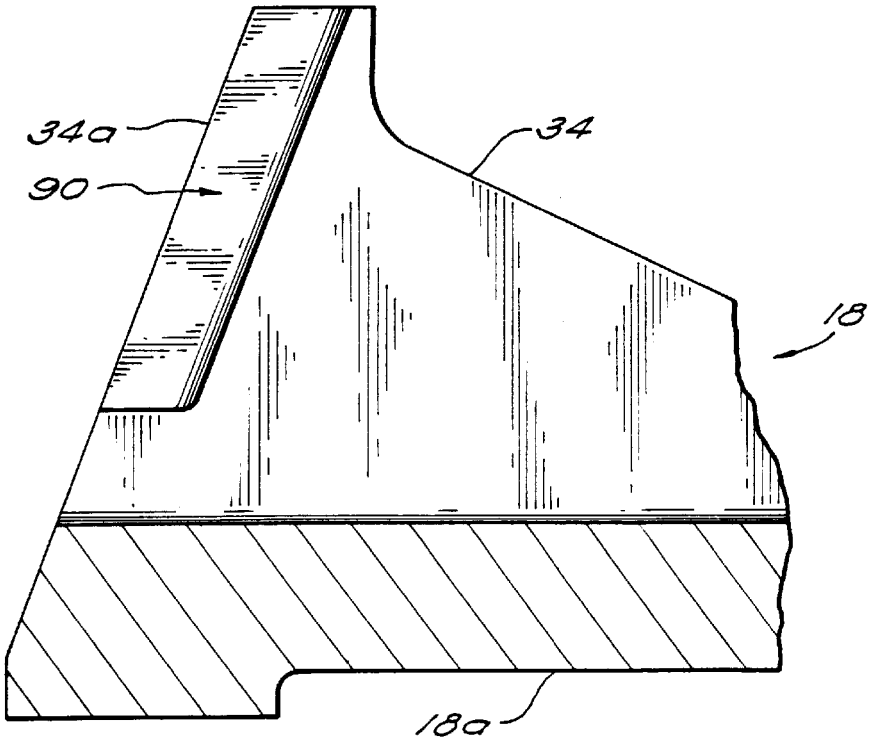
FIGS. 9C is a view along line 9C—9C in FIG. 9A.

FIGS. 9A–9C illustrate a profiled blade end 90 useful in reducing wear when very abrasive materials are being defibered, e.g. flooring base material containing an abrasive material. The profile 90 is in the form of a generally wedge-shaped recess machined in the upper, trailing end of blade edge 34*a*. The widest end of the recess is at the top of the blade resulting in the thinnest part of the blade at its uppermost end. This configuration avoids a concentration of wear at the upper edge of the rotor-stator interface where the abrasive material first enters. Instead, the profile reduces the available surface for rotor-stator wear at the upper end and facilitates its entry into the interface as a point closer to the rotor plate 18*a*. This distributes the wear more evenly over the interface, providing a longer life. The precise shape and size of the profile is not critical as long as it performs these functions. The wedge shape shown, with a flat, ramp-like configuration, is preferred for ease of machining, but it could be curved. By way of illustration, but not of limitation for the size of rotor and rotor blades described above, the wedge-shaped extends axially for 2.75 inch, leaving the blade with a thickness (in the direction of rotation) of 0.25 inch at its tip. The wedge in its preferred form shown is uniform and extends over about 80% of the height of the blade edge. The wedge recess has a thickness, in this example, of about 0.5 inch at the blade tip. Variations in the configuration and dimensions of this profiling are limited by the strength and rigidity required of the blade and its wear characteristics in use which can be determined empirically and/or though conventional stress analysis techniques.

Figure 10A:
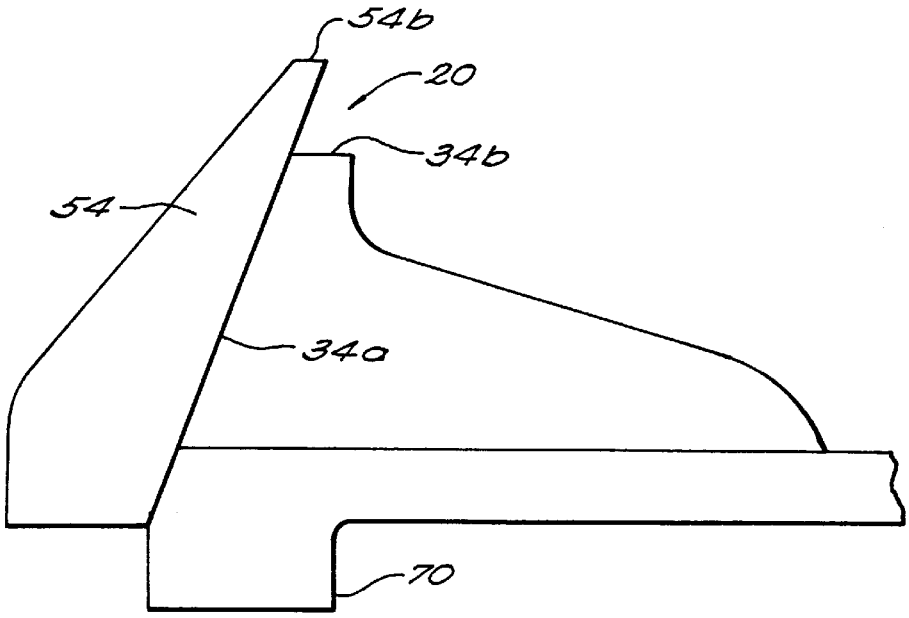
FIGS. 10A and 10B show the reduction interface between the rotor and stator pairs of any of FIGS. 1–7F with the rotor in an initial unworn position in FIG. 10A, and a worn position in FIG. 10B after axial position adjustment to compensate for wear.
Figure 10B:
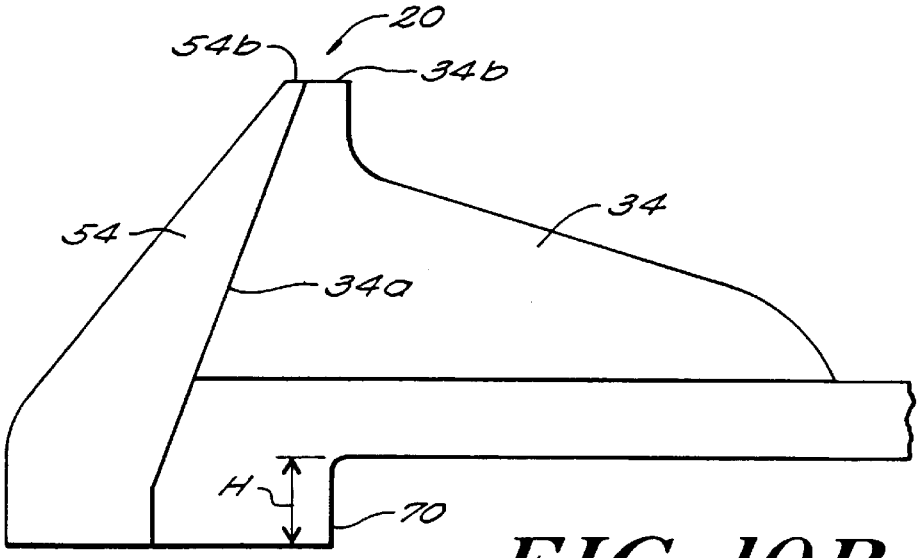

FIGS. 10A and 10B illustrate a rotor-stator construction and method of operation of the pulper which can compensate for wear at the rotor stator interface and thereby greatly extend the service life of the pulper and reduce down-time for maintenance. As shown in FIG. 10A, the rotor has an axially thickened (dimension H in FIG. 10B) periphery in the form of a rearwardly extending peripheral flange 70. The rotor initially nests in the stator only partially—the "upper" edge 34*b* on the vane lies below the upper edge 54*b* of the lobe at its maximum height. The outer surface of the flange 70 is cylindrical with a diameter no greater than the inside diameter of the stator.

As the rotor and stator wear at the interface 70, the rotor is periodically advanced into the stator, as by adjusting the axial position of the drive-train using the handwheel 28 and gear and rack assembly 30. Each advance is sufficient to compensate for wear and reset the interface clearance to the desired operating value. Eventually the wear is sufficient that the rotor reaches the position shown in FIG. 10B with the rotor fully seated in the stator and the upper edges 34*b* and 54*b* are generally coplanar. Note that the flange 70 progressively nests in the stator to maintain a desired rotor-to-stator area of interface. As compared to the standard Tornado® pulper, the stator lobe is also thickened so that after wear on the stator it nevertheless has a thickness sufficient to provide the necessary rigidity and structural strength. It is at least twice the axial thickness of the stiffening peripheral flange now used on the rotor of the comparably-sized Tornado® pulper. By way of illustration, but not of limitation, for a nine-lobe, 36 inch diameter stator according to this invention, the stator lobes have an initial thickness of 1.00 inch at their peak and the flange 70 extends axially for about 5.00 inches.

Figure 11A:
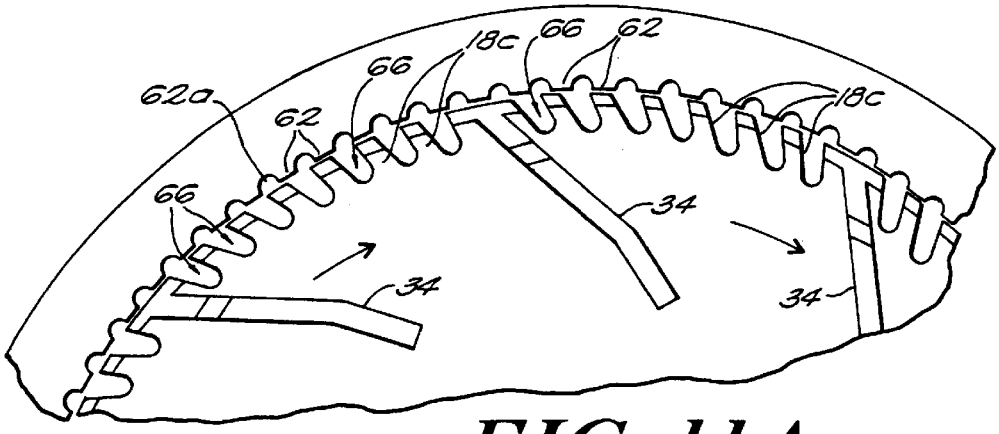
FIGS. 11A is a detailed view of the standard rotor teeth configuration shown in FIGS. 3 and 5B.

FIG. 11A shows in detail "standard" rotor teeth 18*c* that act in cooperation with opposed bars 62 on the stator 16 to defiber through a milling action. For a 36 inch diameter rotor, the teeth 18*c* preferably have a width of about ⅝ inch, spaced by circumferential gaps 66 of about ⅞ inch. The teeth 18*c* are preferably raked backwardly (with respect to the direction of rotation of the rotor) by about 45° measured from a radial line passing through the center of rotation and the tooth.

While this size and configuration works well for many paper and pulp industry applications, it does not yield optimal results when used in certain other applications, or even in certain paper and pulp applications. A major design problem is that the rotor-stator combination in operation is in effect a highly efficient moving screen. Because of this efficiency, it has proven difficult to achieve a non-standard degree of defibering; e.g., in instances where it is important to produce coarse (long) fibers.

Figure 11B:
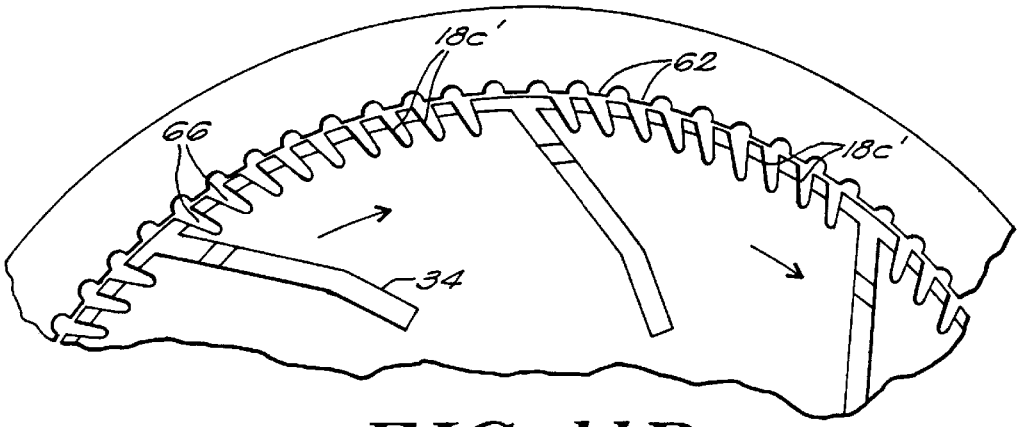
FIG. 11B is a view corresponding to FIG. 11A a showing rotor teeth according to the present invention suitable for fine defibering.
Figure 11C:
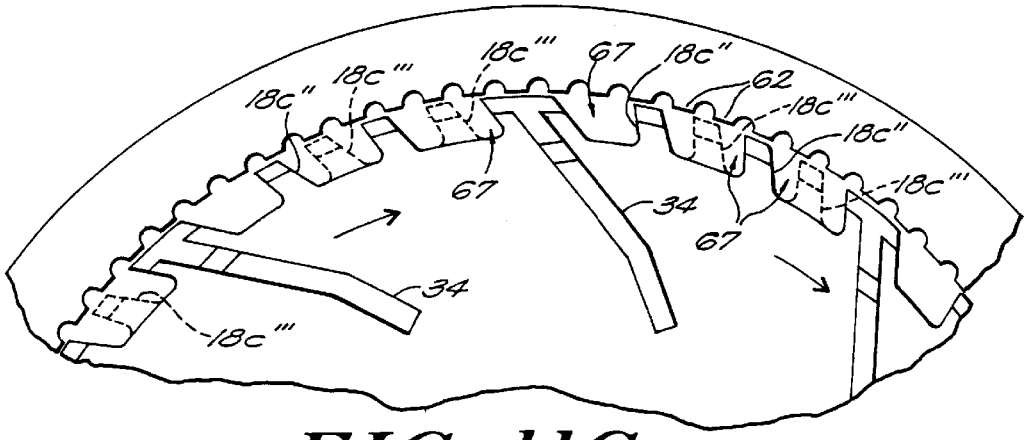
FIG. 11C is a view corresponding to FIGS. 11A and 11B showing rotor teeth according to the present invention suitable for coarse defibering, with an alternative embodiment shown in phantom.

FIGS. 11B and 11C show a rotor teeth array 18*c*', according to the present invention adapted for fine milling action and rotor teeth arrays 18*c*" and 18*c*'" adapted for coarse milling. For fine milling, the number of teeth 18*c*' is increased by approximately 50% to 100% and the inter-tooth spacings 66 are reduced in width accordingly. The exact size and configuration of the teeth and spacings can vary, provided that: i) there is a requisite increase in frequency of the milling action (for a given diameter rotor operating at a given speed); ii) the teeth are structurally strong enough to withstand the stresses that are applied in operation without deforming or breaking; iii) the openings 66 do not plug or clog readily; and iv) the mass of the teeth is distributed rotationally symmetrically. By way of illustration but not of limitation, for a 36 inch diameter rotor, the fine teeth 18*c*' shown in FIG. 11B are ⅝ inch wide (at the outer diameter of the rotor measured in the direction of rotation) and ninety in number. The openings 66 extend radially for 1.0 inch and are ⅜ inch in width at the outside diameter of the rotor. In contrast, the standard rotor teeth 18*c* are 63 in number, with the dimensions and spacings noted above. (Except that in each of the FIGS. 11A–11C embodiments the tooth at the blade 34 spans a blade and a region on either side, typically with a total circumferential length of 2.0 inches, again, for a 36 inch diameter rotor.) It has been found that the rotor tooth 18*c*' can reliably produce a fine defibering without modifications to, or a re-design of, the stator, particularly the size and configuration of the bars 62 and channels 62*a*.

The rotor teeth 18*c*" shown in FIG. 11C are sized and configured like the teeth 18*c* shown in FIG. 11A, except that every other tooth is omitted to produce large inter-tooth pockets 67 between adjacent teeth. Also, a pocket 67 leads at least each of three equiangularly spaced blades 34. The pockets 67 are located so that the rotor teeth 18*c*' are distributed to be rotationally symmetric. With the teeth 18*c*" and pockets 67, the rotor can defiber effectively to a coarse fiber length while operated in a standard manner with a stator having a standard array of bars 62 and channels 62*a*.

FIG. 11C also shows in phantom an alternative arrangement for coarse defibering, which includes rotor teeth 18*c*'" in pockets 67 except a "first" pocket immediately preceding each blade 34, or each of three equiangularly spaced blades 34. These teeth 18*c*'" are, as with the teeth 18*c*", sized and configured like the teeth 18*c* and spaced to produce a rotationally symmetric mass distribution. This alternative arrangement, using only three equiangularly spaced pockets, has been able to defiber rags coarsely for use in paper making without making any other equipment modifications or modifications in the operating procedures.

In all of these examples, the rotor teeth are the standard thickness (measured axially) for a 36 inch diameter rotor, 1.25 inch, and the leading cutting edges are preferably formed of a hardened steel alloy to hold a sharp cutting edge.

There has been described a stator for a rotor-stator pair of a pulper, as well as a complete pulper and pulper system which can operate in conjunction with a large size tank to reduce in size and defiber difficult materials. The invention provides a readily implemented mechanical solution which allows the processing of a wide variety of difficult raw materials into a wide variety of end products mechanically, without heating and chemicals. This invention also provides a simple mechanical solution to the problem of inconsistency in fiber length caused by the ability of fibers to bypass the action of the rotor teeth.

There has also been described a construction and method of operation of a rotor-stator pair which compensates for wear at the rotor-stator interface without replacement of any parts and the attendant costs for a replacement part and production down-time for the replacement. There has also been described a rotor blade construction which reduces wear when processing very abrasive materials and a rotor tooth construction which can defiber to fine and coarse fiber lengths without other changes in the pulper or its mode of operation, and without the use of special auxiliary equipment.

While the invention has been described with respect to its preferred embodiments, various modifications and alterations will occur to those skilled in the art. For example, while the lobes have been described as generally solid isosceles triangles, they can be configured differently as long as the acquisition edge is present at the correct angle for the scissor action, the attrition zone channels are available, the surface area of the lobes conform to the present invention, and the lobes are otherwise structurally strong enough to withstand the forces applied to them. Similarly the blades can take different forms, and the cutting and pump functions could even be divided among separate elements on the rotor. A variety of arrangements can be devised to advance the rotor to compensate for wear, whether manually or automatically. While nine lobes are described as completely surrounding a 36-inch diameter interface, the number of lobes can vary for that size pulper, or differently sized pulpers. While the tank has been described as cylindrical, it can be oval, rectangular, or other more complex shapes, albeit perhaps at great cost or with some loss of energy or effectiveness of the agitation flow in the tank. Further, while the pulper 14 has been described as mounted in the tank side wall, it could be mounted in the bottom wall. They and other modifications and variations are intended to fall within the scope of the appended claims.

What is claimed is:

1. In a rotor-stator pair for reducing and defibering a difficult material in a stock where the rotor has a plate-like base that rotates inside the stator to form an attrition interface in the form of a truncated cone between (i) a first zone defined by cutting edges on upright blades of the rotor and a second zone defined by teeth on the outer periphery of the rotor base and (ii) a plurality of alternating cutting bars and flow channels formed on an inner side wall of the stator, a mechanical system that assures attrition of all of the material in the interface by said cutting teeth acting in cooperation with the bars despite the presence of the channels and inter-tooth spacings, comprising, a first structure located on the lower inner face of said stator that deflects the flow of stock through from the first zone to the second zone and a second cooperating structure on said rotor in the spaces between the teeth to block any flow through said spaces which would by-pass the second zone.

2. The mechanical attrition assurance system of claim 1 wherein said first and second structures are formed integrally with the stator and the rotor, respectively.

3. The mechanical attrition assurance system of claim 2 wherein said first deflector is a planar inclined ramp closing the channels at the outer diameter of said teeth.

4. In a rotor-stator pair for reducing and defibring a difficult material in a stock where the rotor has a plate-like base that rotates inside the stator to form an attrition interface in the form of a truncated cone between (i) a first zone defined by cutting edges on upright blades of the rotor and a second zone defined by teeth on the outer periphery of the rotor base and (ii) a plurality of alternating cutting bars and flow channels formed on an inner side wall of the stator, a mechanical arrangement for increasing the useful life of the rotor-stator pair when operating with highly abrasive difficult materials, comprising, a profiled upper end of each of said upright blades at the region behind said cutting edges, said profiling comprising an increasing thinning of the area of the blade end opposite the interface with the blade height, said thinning being in the form of a wedge-recess in the trailing portion of each of said upper ends.

* * * * *